US006615863B2

(12) United States Patent
Le

(10) Patent No.: US 6,615,863 B2
(45) Date of Patent: Sep. 9, 2003

(54) TOILET FILL VALVE TANK ISOLATION

(75) Inventor: Tuan V. Le, Diamond Bar, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 0 days.

(21) Appl. No.: 10/168,288

(22) PCT Filed: Feb. 16, 2001

(86) PCT No.: PCT/US01/05016

§ 371 (c)(1),
(2), (4) Date: Jun. 17, 2002

(87) PCT Pub. No.: WO01/61228

PCT Pub. Date: Aug. 23, 2001

(65) Prior Publication Data

US 2002/0189678 A1 Dec. 19, 2002

Related U.S. Application Data

(60) Provisional application No. 60/182,846, filed on Feb. 16, 2000.

(51) Int. Cl.[7] ..... F16K 47/02; F16K 31/34

(52) U.S. Cl. ..... 137/443; 137/15.26; 137/413; 137/426; 137/429; 137/436

(58) Field of Search ..... 137/413, 414, 137/429, 436, 437, 216, 217, 218, 443, 444, 15.26, 426, 435

(56) References Cited

U.S. PATENT DOCUMENTS

| | | | | | |
|---|---|---|---|---|---|
| 2,847,026 | A | | 8/1958 | Nelson | 137/434 |
| 3,930,516 | A | * | 1/1976 | Flinner | 137/436 |
| 4,338,964 | A | * | 7/1982 | Schoepe | 137/443 |
| 4,414,998 | A | * | 11/1983 | Rudler et al. | 137/216 |
| 4,416,302 | A | * | 11/1983 | Schoepe | 137/443 |
| 4,699,169 | A | | 10/1987 | Sherby | 137/434 |
| 4,938,245 | A | | 7/1990 | Schoepe et al. | 137/2 |
| 5,280,803 | A | * | 1/1994 | Swift et al. | 137/426 |
| 5,287,882 | A | | 2/1994 | Mikol | 137/410 |
| 5,738,141 | A | * | 4/1998 | Blanke et al. | 137/414 |
| 6,354,326 | B1 | * | 3/2002 | Le et al. | 137/414 |

* cited by examiner

*Primary Examiner*—George L. Walton
(74) *Attorney, Agent, or Firm*—Richard L. Myers; Myers Dawes Andras & Sherman LLP

(57) ABSTRACT

A toilet fill valve (16) includes a fill tube (21) which is mounted through a hole (14) in a toilet tank wall (12), having isolating means for isolating the fill tube (21) from direct contact with the toilet tank wall (12), as well as isolating water-borne noise and vibration in the fill tube (21) from direct transmission to the wall (12) of the tank (10).

23 Claims, 3 Drawing Sheets

TOILET FILL VALVE TANK ISOLATION

CROSS REFERENCE TO RELATED APPLICATIONS

This is a non-provisional application claiming the priority of Provisional Application Ser. No. 60/182,846 filed on Feb. 16, 2000 and entitled TOILET FILL VALVE TANK ISOLATION.

BACKGROUND OF THE INVENTION

1. Field of the Invention

This invention relates primarily to toilets and water closets with their associated hardware, and more specifically to toilet fill valves and hardware associated with mounting those valves in a toilet tank.

2. Discussion of the Prior Art

Toilets and water closets, and their associated hardware, have been highly refined over the years. For example, flush valves have been designed to produce variable flush volumes with a high degree of product manufacturability. Similarly, fill valves have been designed with a high degree of accuracy and reliability as well as manufacturability. Notwithstanding these achievements in the art, it has become increasingly desirable to reduce the levels of sound associated with operation of the toilet and its components.

During the filling of the tank with water, noise and vibrations are produced by the fill valve. These noises are borne by the water and readily transmitted by any rigid structure. Toilet fill valves of the past have been directly mounted to the wall of the toilet tank by a shank or fill pipe through which water is received from an outside source. Water-borne noise and vibration associated with the fill valve has been readily transmitted to the wall of the toilet tank by the rigid mounting hardware used to mount the fill valve to the tank wall. These sounds and vibrations have been highly amplified by the tank structure which presents large, flat surfaces within the room.

In the past, a hole has been provided in the wall of the toilet tank and adapted to receive the shank or fill tube of the fill valve through the wall. The fill tube has been inserted through the hole from inside the tank and allowed to rest by gravity in the bottom of the hole. Hardware associated with mounting the fill tube to the tank has typically included a flange or metal washer on the inside of the tank wall, and a metal washer and threaded nut on the outside of the tank wall. These rigid connections, as well as the mere contact of the shank with the toilet wall, have easily transmitted the water-borne noise and vibrations from the fill valve to the tank. Amplification of these sounds and vibrations by the walls of the tank have resulted in a high degree of noise transmission to the room during operation of the fill valve.

SUMMARY OF THE INVENTION

These deficiencies of the prior art are overcome with the present invention which includes isolation means disposed between the fill valve and the tank for inhibiting the transmission of water-borne sound and vibration from the fill valve to the wall of the tank. This is accomplished in a preferred embodiment by placing a non-rigid material between the fill valve and the tank in order to dampen the sounds and vibrations emanating from the fill valve.

This isolation means can be any material, even air, which reduces contact between the fill valve and the tank wall. The material may be a gel or elastomeric material preferably having a durometer less than about 55 Shore A. As opposed to the metal and hard plastic materials of the past, these low durometer materials will effectively reduce the amount of noise transmitted to the tank wall during the fill operation.

In one aspect of the invention, a toilet includes a toilet bowl and toilet tank having a tank wall with a hole extending through the wall. A fill valve includes a fill tube which is mounted through the hole in the tank wall. A first washer is disposed on the fill tube interiorly of the tank wall while a second washer is disposed on the fill tube exteriorly of the tank wall. A nut engaging the fill tube is isolated from the tank wall by these washers. Centering means is provided to maintain the fill tube in a spaced relationship with the tank wall.

In another aspect of the invention, an attachment assembly engages the tank portions defining the hole as well as the fill tube of the fill valve, in order to maintain the wall and the tube in a fixed relationship and a spaced relationship. In a further aspect, the invention includes non-rigid means disposed between the tank wall and the fill tube for damping water-borne sounds and vibrations.

In still a further aspect, the invention includes a method for mounting a fill valve to the wall of the toilet. The method includes steps of providing the fill valve with a fill tube having a first diameter and forming a hole in the tank wall with a second diameter greater than the first diameter of the fill tube. A boss is mounted on the fill tube of the fill valve within the hole of the tank wall. The fill tube is inserted through the hole and coupled to the tank wall in an indirect, fixed relationship. The fill tube is isolated from direct contact with the wall of the tank.

These and other features and advantages of the invention will become more apparent with a description of preferred embodiments and reference to the associated drawings.

DESCRIPTION OF PREFERRED EMBODIMENTS

Figure 1:
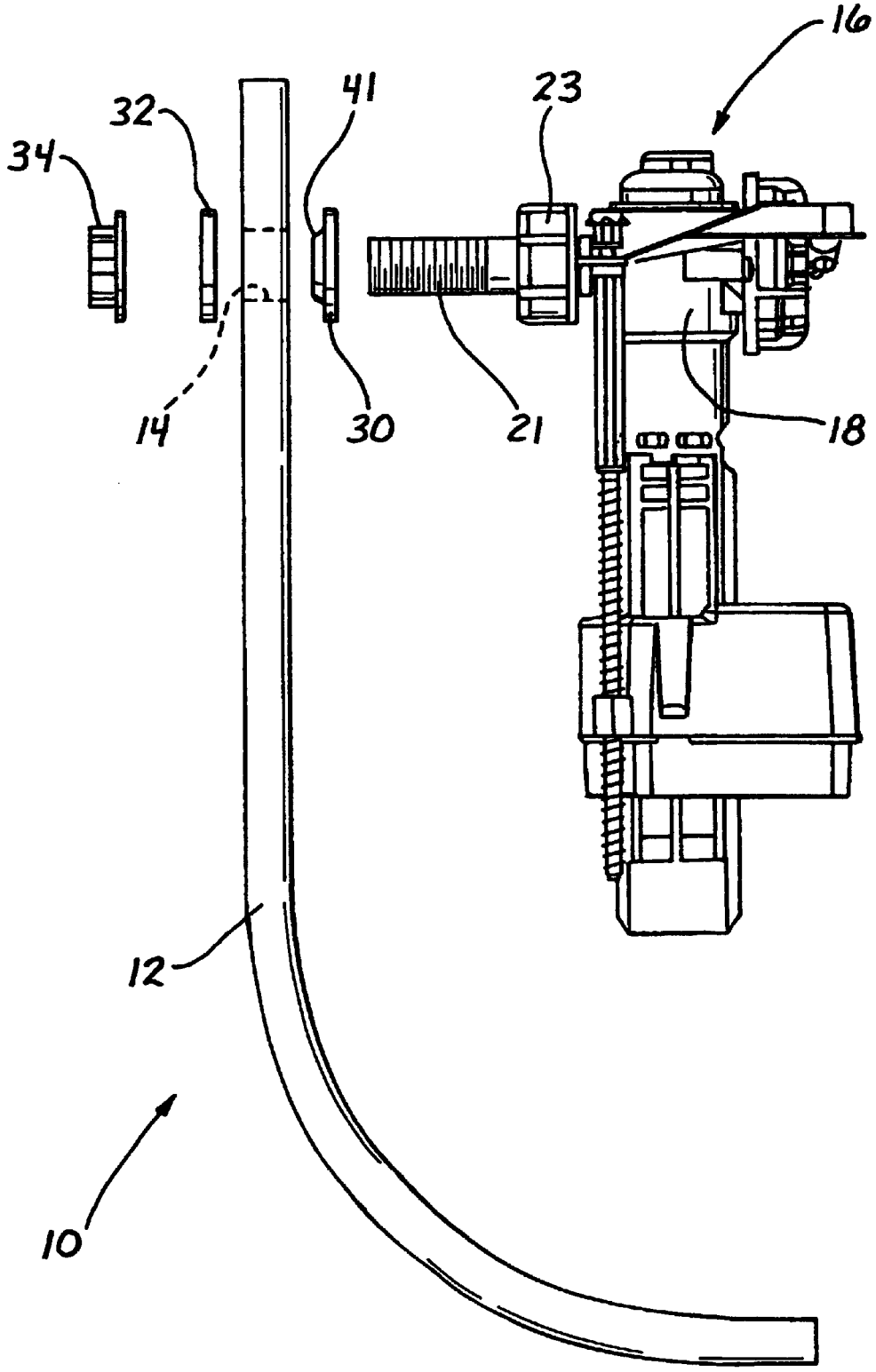
FIG. 1 is a side-elevation exploded view of a toilet tank and fill valve with mounting hardware of the present invention.

Toilets and water closets, commonly include tanks which are initially filled with a reservoir of water which is ultimately used to flush the toilet. A portion of the toilet tank is illustrated in FIG. 1 and designated by the reference numeral 10. The tank 10 is generally formed with a tank wall 12, portions of which define a hole or passage 14 through the wall 12. This hole 14 in a preferred embodiment has a diameter of about one inch.

Also illustrated in the exploded side view of FIG. 1 is a fill valve 16 having a housing 18, and a shank or fill tube 21 coupled to the housing 18 by a connector 23. When operatively disposed, the fill tube 21 of the fill valve 16 is disposed through the passage or hole 14 in the tank wall 12 where it is adapted to receive water through the tank wall.

The fill valve 16 is a complex structure including not only valving structures but also a down-tube and float. Water entering the fill valve 16 through the fill tube 21 is exposed to many restrictions, expansions, and turns as it negotiates a tortuous path through the fill valve 16. As a result of this tortuous water flow, a high level of water-borne noise can be generated by the valve 16 along with sounds resulting from vibration of the valve 16. It is of interest to the present invention to reduce the transmission of such noises and vibrations from the valve 16 to the tank wall 12. Noting that the tank wall 12 presents major surfaces to the room housing the toilet, it can be appreciated that vibrations in this structure can greatly amplify the noise and sound emitted to the room.

In accordance with the present invention, the structures associated with the fill valve 16 are isolated from the tank wall 12 as much as possible in order to inhibit the transmission of the noise and vibrations from the valve 16 to the wall 12. Direct contact between the valve 16 and the wall 12 is prevented, while indirect contact, necessary to mount the valve 16 to the valve wall 12, is accomplished without direct contact and only through materials which have properties for damping the noise and vibration. These materials may include gases such as air, or liquids such as gels, or solids such as elastomeric materials.

Figure 2:
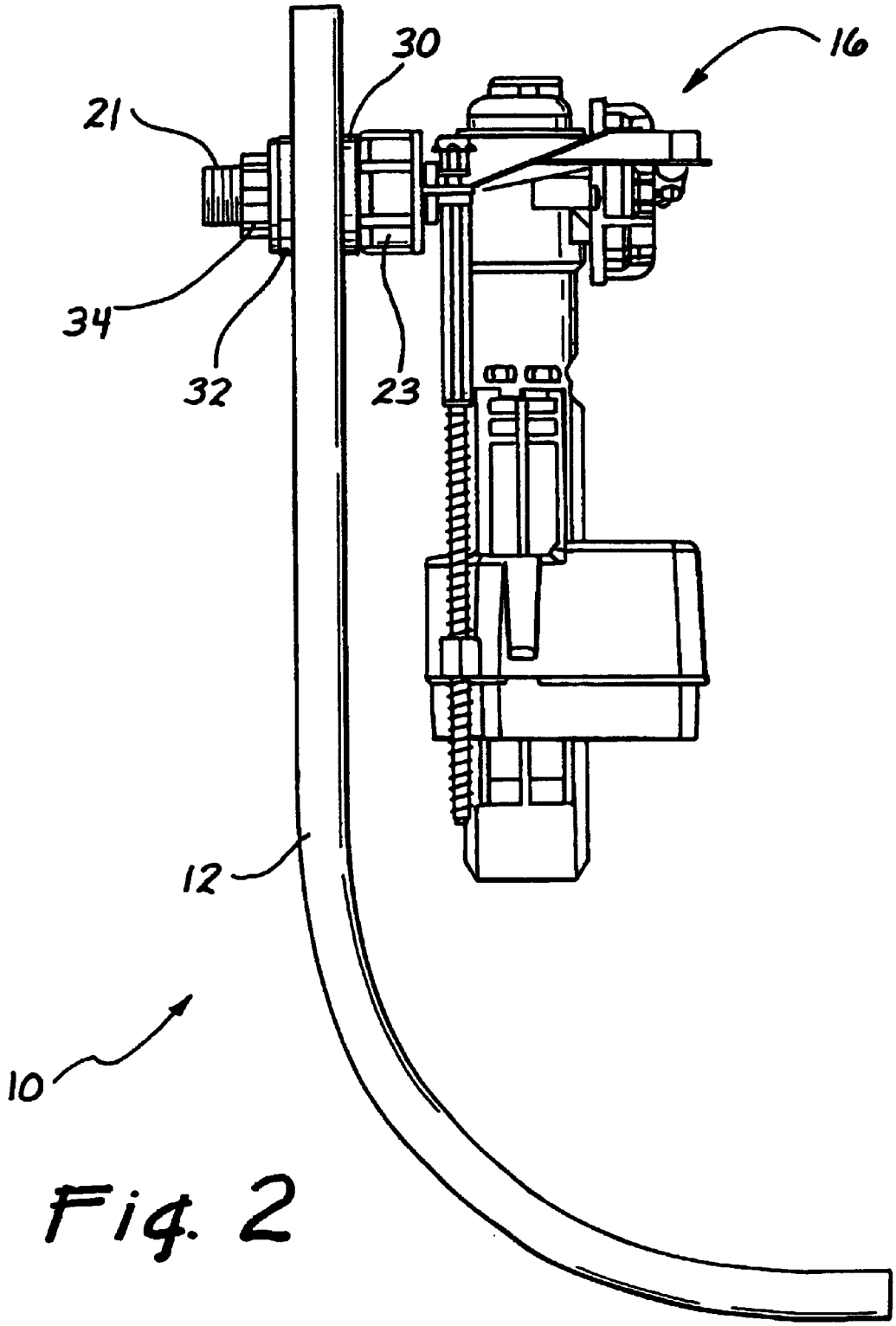
FIG. 2 is a side-elevation view showing the fill tube fixed to the walls of the tank but isolated from the walls of the tank by low durometer materials.

In the illustrated embodiment, an interior washer 30 is provided for disposition on the fill tube 21 between the fill valve 16 and the inner surface of the tank wall 12. With the fill valve 16 operatively disposed and the fill tube 21 extending through the passage 14, an exterior washer 32 can be provided for disposition on the fill tube 21 exteriorly of the wall 12. In a typical case wherein the fill tube 21 includes external threads, a nut 34 can be provided with interior threads which engage the fill tube 21 and hold it securely in a fixed relationship with the tank wall 12. This operative disposition of the fill valve 16 is illustrated in FIG. 2. In this case the elements of structure which might be formed from less-than-rigid materials might include the fill tube 21, the interior washer 30 and the exterior washer 32.

In a preferred embodiment, the diameter of the fill tube 21 is not merely less than the diameter of the hole 14, but significantly less. For example, in a preferred embodiment, the fill tube 21 has an outside diameter of about three-quarters inch. With this significant difference in diameters, the fill tube 21 can be centered within the passage 14 so that there is no direct contact between the fill valve 16 and the tank wall 12.

Figure 3:
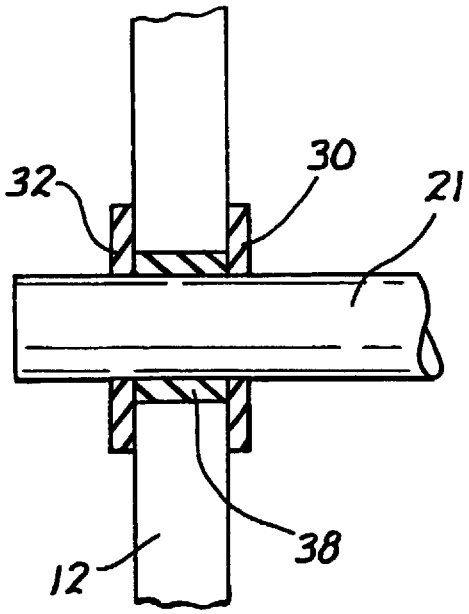
FIG. 3 is a close-up view showing the fill tube extending through a cylindrical boss.
Figure 4:
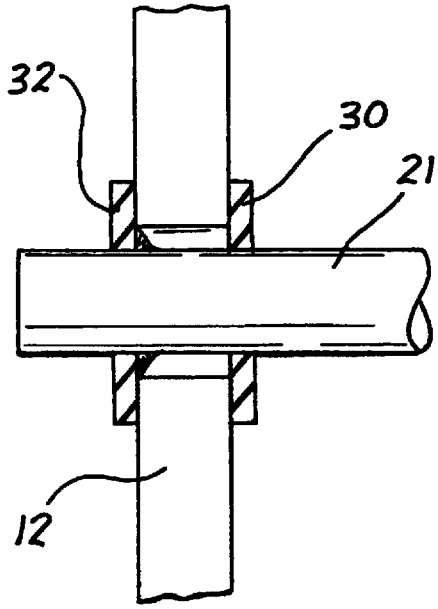
FIG. 4 is a close-up view showing an annulus formed on an external washer.
Figure 5:
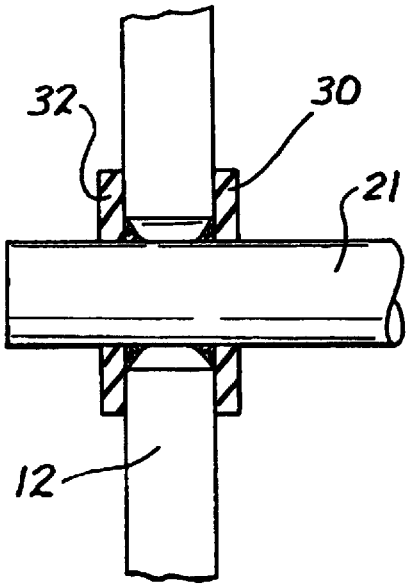
FIG. 5 is a close-up view showing an annulus formed on an external washer and on an internal washer.

In a preferred embodiment, the centering of the fill tube 21 is achieved automatically by providing either one or both of the washers 30 and 32 with a boss which extends between the fill tube 21 and the wall 12 defining the passage 14. The boss can be cylindrical to form a sleeve 38 as illustrated in FIG. 3. Alternatively, the boss may include an annulus 41 having an outer surface with a frusto-conical configuration. This annulus 41 can be formed integral with the interior washer as illustrated in FIG. 1, the exterior washer as illustrated in FIG. 4, or both washers 30 and 32 as illustrated in FIG. 5.

Returning to FIG. 2, it will be noted that the fill valve 16 can be attached to the toilet tank in a fixed relationship, but totally isolated from direct contact with the wall 12. More specifically, in the preferred illustrated embodiment, the fill tube 21 is surrounded by air within the passage 14 so there is no direct contact with the wall 12. Indirect contact with the wall 12 is only permitted through the washers 30 and 32 and associated annulus 41 which are formed of the low durometer material. Thus, even this indirect contact between the fill valve 16 and wall 12 is significantly inhibited by the low durometer materials.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

What is claimed is:

1. A toilet, comprising:

a toilet bowl;

a toilet tank having a tank wall defining a tank reservoir and being adapted to store water for flushing the toilet, the water defining a water line;

side portions of the tank wall defining a hole through the tank wall above the water line, the hole having a first diameter;

a fill valve mounted to the tank wall and adapted to receive water through the tank wall into the tank reservoir, the fill valve having properties for producing water-borne sounds and vibrations;

a fill tube included in the fill valve, the fill tube having a second diameter less than the first diameter of the hole and being adapted to receive water through the tank wall and into the tank reservoir;

a first washer disposed on the fill tube interiorly of the tank wall;

a second washer disposed on the fill tube exteriorly of the tank wall;

a nut engaging the fill tube for maintaining the fill tube in a generally fixed relationship with the tank wall; and means associated with at least one of the first washer and second washer for centering the fill tube of the fill valve in the hole of the tank wall to isolate the fill tube from direct contact with the tank wall; whereby the water-borne noise and vibration in the fill tube are isolated from direct transmission to the wall of the tank.

2. The toilet recited in claim 1, wherein the centering means is formed of a material having properties for damping the water-borne noise and vibration passing from the fill tube indirectly through the centering means to the wall of the tank.

3. The toilet recited in claim 1, wherein the centering means comprises a boss having an annular configuration and extending axially from a third diameter less than the first diameter of the hole to a fourth diameter greater than the first diameter of the hole.

4. The toilet recited in claim 3, wherein the boss has a frusto-conical configuration.

5. The toilet recited in claim 3, wherein the boss is associated with the first washer and is disposed generally interiorly of the tank between the first washer and wall of the tank.

6. The toilet recited in claim 3, wherein the boss is associated with the second washer and is disposed generally exteriorly of the tank between the second washer and wall of the tank.

7. The toilet recited in claim 3, wherein the boss is integral with the associated first washer and second washer.

8. The toilet recited in claim 3, wherein the boss is a first boss, and the toilet further comprises a second boss associated with the other of the first washer and the second washer.

9. A toilet, comprising:

a toilet bowl;

a toilet tank having a tank wall defining a tank reservoir adapted to store water for flushing the toilet, the water defining a water line;

side portions of the tank wall defining a hole through the tank wall above the water line, the hole having a first diameter;

a fill valve mounted to the tank wall and adapted to receive water through the tank wall into the tank reservoir, the fill valve having properties for producing water-borne sounds and vibrations;

a fill tube included in the fill valve, the fill tube having a second diameter less than the first diameter of the hole and being adapted to receive water through the tank wall and into the tank reservoir; and an attachment assembly engaging the tank portions defining the hole and the fill tube of the fill valve to maintain the tank wall and fill tube in a fixed relationship and a spaced relationship to dampen the water-borne sounds and vibrations in the fill tube.

10. The toilet recited in claim 9, wherein the attachment assembly comprises:

a centering device having an axis and being adapted to receive the fill tube along the axis, the device having a frusto-conical surface coaxial with the fill tube for engaging the tank portions to center the fill tube in the hole in a spaced relationship with the tank wall.

11. The toilet recited in claim 10, wherein;

the fill tube has external threads; and the centering device includes a nut having interior threads adapted to engage the exterior threads of the fill tube, and the frusto-conical surface engages the tank portions defining the hole.

12. The toilet recited in claim 11, wherein the frusto-conical surface is carried by the nut.

13. The toilet recited in claim 11, further comprising:

a washer mounted on the fill tube and disposed in juxtaposition to the tank wall, the frusto-conical surface being defined by portions of the washer.

14. A toilet, comprising:

a toilet bowl;

a toilet tank having a tank wall defining a tank reservoir adapted to store water for flushing the toilet, the water defining a water line;

side portions of the tank wall defining a hole through the tank wall above the water line, the hole having a first diameter;

a fill valve mounted to the tank wall and adapted to receive water through the tank wall into the tank reservoir, the fill valve having properties for producing water-borne sounds and vibrations;

a fill tube included in the fill valve, the fill tube having a second diameter less than the first diameter of the hole and being adapted to receive water through the tank wall and into the tank reservoir; and non-rigid means disposed between the side portions of the tank wall defining the hole and the fill pipe for centering the fill tube in the hole and spacing the fill tube from the tank wall for dampening the water-borne sounds and vibrations of the fill valve from the tank wall.

15. The toilet recited in claim 14, wherein the non-rigid means includes a material having a durometer less than 55 Shore A.

16. The toilet recited in claim 15, wherein the non-rigid means includes an elastomeric material.

17. The toilet recited in claim 15, wherein the non-rigid means includes air.

18. A method for mounting a fill valve to a wall of a toilet tank, the toilet tank being adapted to store water, the water defining a water line, the method comprising the steps of:

providing the fill valve with a fill tube having a first diameter and being adapted to conduct water into the tank;

providing a hole in the tank wall above the water line with a second diameter greater than the first diameter of the fill tube;

mounting a boss on the fill tube to center the fill tube of the fill valve within the hole of the tank wall;

inserting the fill tube through the hole in the tank wall;

coupling the fill tube in an indirect fixed relationship with the wall of the tank; and during the coupling step, isolating the fill tube from direct contact with the wall of the tank to dampen water-borne sounds and vibrations in the fill tube.

19. The method recited in claim 18, wherein the coupling step further comprises the steps of:

placing an interior washer on the fill tube interiorly of the tank;

placing an exterior washer on the fill tube exteriorly of the tank;

during the mounting step, positioning a boss between an associated one of the interior washer and the exterior washer, and the tank wall.

20. The method recited in claim 19, wherein prior to the mounting step, the method further comprises the step of:

providing the boss integrally with the associated one of the interior washer and exterior washer.

21. The method recited in claim 20, wherein the boss is a first boss and the method further comprises the step of:

providing a second boss integrally with the other of the interior washer and the exterior washer.

22. The method recited in claim 20, wherein the method further comprises a step of providing the boss with a cylindrical configuration.

23. The method recited in claim 20 wherein the method further comprises a step of providing the boss with a frusto-conical configuration.

* * * * *